US007335240B2

(12) United States Patent
Gunderson et al.

(10) Patent No.: US 7,335,240 B2
(45) Date of Patent: Feb. 26, 2008

(54) AIR FILTER UNIT AND SERVICE LINE ENCLOSURE FOR A REFRIGERATOR

(75) Inventors: Rick L. Gunderson, Greenville, MI (US); Joseph E. Brand, Sheridan, MI (US)

(73) Assignee: Electrolux Home Products, Inc., Cleveland, OH (US)

( * ) Notice: Subject to any disclaimer, the term of this patent is extended or adjusted under 35 U.S.C. 154(b) by 379 days.

(21) Appl. No.: 11/012,407

(22) Filed: Dec. 15, 2004

(65) Prior Publication Data

US 2006/0123747 A1 Jun. 15, 2006

(51) Int. Cl.
*B01D 50/00* (2006.01)

(52) U.S. Cl. ..... 55/316; 55/470; 55/471; 55/472; 55/485; 55/502; 55/507; 55/511; 62/89; 62/234; 62/276; 62/418; 62/440

(58) Field of Classification Search ..... 55/316, 55/470, 471, 472, 485, 502, 507, 511, 385.1; 62/89, 276, 234, 418, 440
See application file for complete search history.

(56) References Cited

U.S. PATENT DOCUMENTS 4,052,179 A * 10/1977 Kirk ..... 96/139
4,737,173 A * 4/1988 Kudirka et al. ..... 96/131
4,904,289 A 2/1990 Miyakami et al.
4,948,567 A 8/1990 Atarashiya
4,955,208 A 9/1990 Kawashima et al.
5,062,272 A 11/1991 Burns
5,078,971 A 1/1992 Matuda et al.
5,230,220 A 7/1993 Kang et al.
5,291,742 A 3/1994 Kawatani et al.
5,347,820 A 9/1994 In Gweon
5,501,084 A 3/1996 Chang et al.
5,568,730 A 10/1996 Kim et al.
5,772,959 A 6/1998 Bermas
5,924,292 A 7/1999 Markum
6,190,440 B1 * 2/2001 Purnell ..... 96/108
6,286,330 B1 9/2001 Kopf
6,454,841 B1 9/2002 Kaiser
2003/0047079 A1 3/2003 Kaiser
2005/0168907 A1 * 8/2005 Sekoguchi et al. ..... 361/230

* cited by examiner

*Primary Examiner*—Duane Smith
*Assistant Examiner*—Minh-Chau T. Pham
(74) *Attorney, Agent, or Firm*—Pearne & Gordon LLP

(57) ABSTRACT

An assembly for installation in a refrigerator provides comprises an enclosure for conducting service lines therethrough and an air filter unit mounted to the enclosure. The air filter unit includes an air filter housing that contains an air filter and includes openings for the ingress of air from the refrigerator which, after passing through the air filter, is discharged to the refrigerator interior through discharge openings in the air filter housing. Means such as a fan is provided to establish a flow of air through the air filter housing. The air filter unit has utility separately from the enclosure for conducting service lines in which case the air filter housing includes first and second portions that are pivotally connected to one another. The air filter within the air filter housing is supported by one of the first and second portions of the air filter housing.

47 Claims, 4 Drawing Sheets

AIR FILTER UNIT AND SERVICE LINE ENCLOSURE FOR A REFRIGERATOR

FIELD OF THE INVENTION

The present invention relates generally to an air filter unit and service line enclosure for a refrigerator.

BACKGROUND OF THE INVENTION

The incorporation of air filter units in refrigerators for filtering the air in the refrigerators is well known. Depending on the type of filtering medium employed, the air filter unit may simply act to deodorize the air inside the refrigerator or the unit may deodorize and otherwise sanitize the interior air of the refrigerator by removing contaminants such as mold spores and bacteria, for example, from the interior air.

In some instances the air flow patterns that typically exist within a refrigerator are relied on for moving the air through the air filter unit. In other instances a means for positively displacing air, such as a fan, is directly associated with the air filter unit to insure that a satisfactory volume of air is passed through the unit. Typically, the air-filtering component of the air filter unit is replaceable and, in that case, preferably, will be readily accessible.

It is also customary in modem refrigerators to incorporate auxiliary equipment and devices, such as ice-makers and water dispensers, for example, that enhance the functionality of the refrigerator for consumers. Typically, such auxiliary equipment and devices require service lines to be routed through the interior of the refrigerator. In addition, the auxiliary equipment and devices can include replaceable components such as water filters for the ice-makers and water dispensers, for example.

For a variety of reasons, including aesthetics, the desirability of taking up as little space as possible in the interior of the refrigerator and the accessability of replaceable components, the configuration of the air filter unit and the system for routing the service lines to the auxiliary equipment and devices, as well as the manner in which the air filter unit, the service lines and the auxiliary equipment and devices are located and arranged within the interior of the refrigerator, is of concern.

SUMMARY OF THE INVENTION

According to one aspect of the present invention, there is provided for installation in a refrigerator having a plurality of interior walls defining a refrigerator interior an assembly including an enclosure having an interior and extending longitudinally between a first end and a second end. A service line opening is provided in the enclosure, and the interior of the enclosure includes a passageway for conducting at least one refrigerator service line between the service line opening and the interior of the enclosure. The assembly is adapted to be mounted to one of the interior walls of the refrigerator. The assembly also includes a housing for an air filter that is mounted to the enclosure. The air filter housing has a first opening for the ingress of air into the air filter housing and a second opening for the discharge of air from the air filter housing. An air filter is located in the filter housing for filtering air entering the air filter housing. An air flow path is adapted to convey to the refrigerator interior air discharged from the second opening in the air filter housing. In a particular aspect, the air flow path is located within the enclosure interior and includes an exhaust opening adjacent the second end of the enclosure. A holder for retaining a water filter can be attached to the first end of the enclosure. Typically, the air filter and the water filter are replaceable in which case they are located generally adjacent one another.

According to another aspect of the invention, the assembly includes means for establishing a flow of air into the air filter housing through the first opening in the air filter housing, through the filter, out of the air filter housing through the second opening in the air filter housing, along the air flow path and into the refrigerator interior. In a particular aspect of the invention, the means for establishing a flow of air into the air filter housing can comprise a fan that is located in the air flow path.

The air filter unit of the invention has utility either separately or together with a service line enclosure. In either case, the air filter unit comprises an air filter housing that has a first portion and a second portion. The first portion and the second portion of the air filter housing are pivotally connected to one another so that the first portion and the second portion of the air filter housing are pivotally separable from one another. The air filter that is located in the air filter housing for filtering air entering the air filter housing is supported by one of the first portion and second portion of the air filter housing so that, when the first portion and the second portion of the air filter housing are pivotally separated, the air filter accompanies the one of the first portion and second portion of the air filter housing by which the air filter is supported. The first portion of the air filter unit can be adapted to be retained in a fixed position so that the second portion of the air filter unit, which supports the air filter, is pivotally movable away from the first portion of the air filter housing. In addition, the air filter unit can be adapted to be mounted within the interior of the refrigerator so that the second portion of the air filter housing is pivotally movable in a downward direction away from the first portion of the air filter housing.

According to a further aspect of the invention, at least a part of the air filter housing is located at the exterior of the enclosure and is displaceable from the remainder of the air filter housing so as to provide access to the air filter within the air filter housing. Further, a part of the remainder of the air filter housing can extend into the interior of the enclosure along side the passageway for conducting at least one refrigerator service line.

According to yet another aspect of the invention, the air filter housing has a generally cylindrical configuration with a longitudinal axis extending substantially parallel to the longitudinal extent of the enclosure so that the air filter housing has a first end nearer the first end of the enclosure and a second end nearer the second end of the enclosure. The first opening in the air filter housing is located adjacent the first end of the air filter housing and the second opening in the air filter housing is located adjacent the second end of the air filter housing. In a further aspect, the air filter housing comprises two longitudinal halves that are separated along a longitudinal plane that extends through the longitudinal central axis of the air filter housing. A first of the longitudinal halves of the air filter housing is fixed to the enclosure and a part thereof is located within the interior of the enclosure. A second of the longitudinal halves is located substantially entirely on the exterior of the enclosure and is mounted for pivotal movement away, and displacement, from the first longitudinal half of the air filter housing so as to provide access to the air filter within the air filter housing. Additionally, the enclosure can includes means for attaching the enclosure to an interior wall of the refrigerator interior.

According to still another aspect of the invention, the enclosure is adapted to be positioned in the fresh food compartment of the refrigerator interior so that the exhaust opening is located adjacent a rear interior wall of the fresh food compartment. In that case, the air flow through the exhaust opening is directed downwardly along the rear interior wall.

According to a further aspect of the invention, the enclosure comprises a three-sided trough having a base wall and two substantially parallel side walls of substantially equal height. Each side wall has a top portion and a bottom portion, with the bottom portion of each side wall being integral with the base wall and the top portion of each side wall extending in the same direction away from the base wall. The trough can be adapted to be mounted to an upper interior wall of the refrigerator so that the top portion of each side wall of the trough is inmmediately adjacent the upper interior wall and the second end of the trough is inmmediately adjacent a rear interior wall of the refrigerator. Means can be provided on each of the side walls of the trough for attaching the trough to the upper interior wall of the refrigerator.

Additional features, advantages, benefits and aspects of the invention will be apparent from the drawings attached hereto and the description set forth below.

For the purpose of facilitating the description of the invention some portions of the figures are presented in a somewhat schematic form.

DETAILED DESCRIPTION OF AN EMBODIMENT OF THE INVENTION

Figure 1:
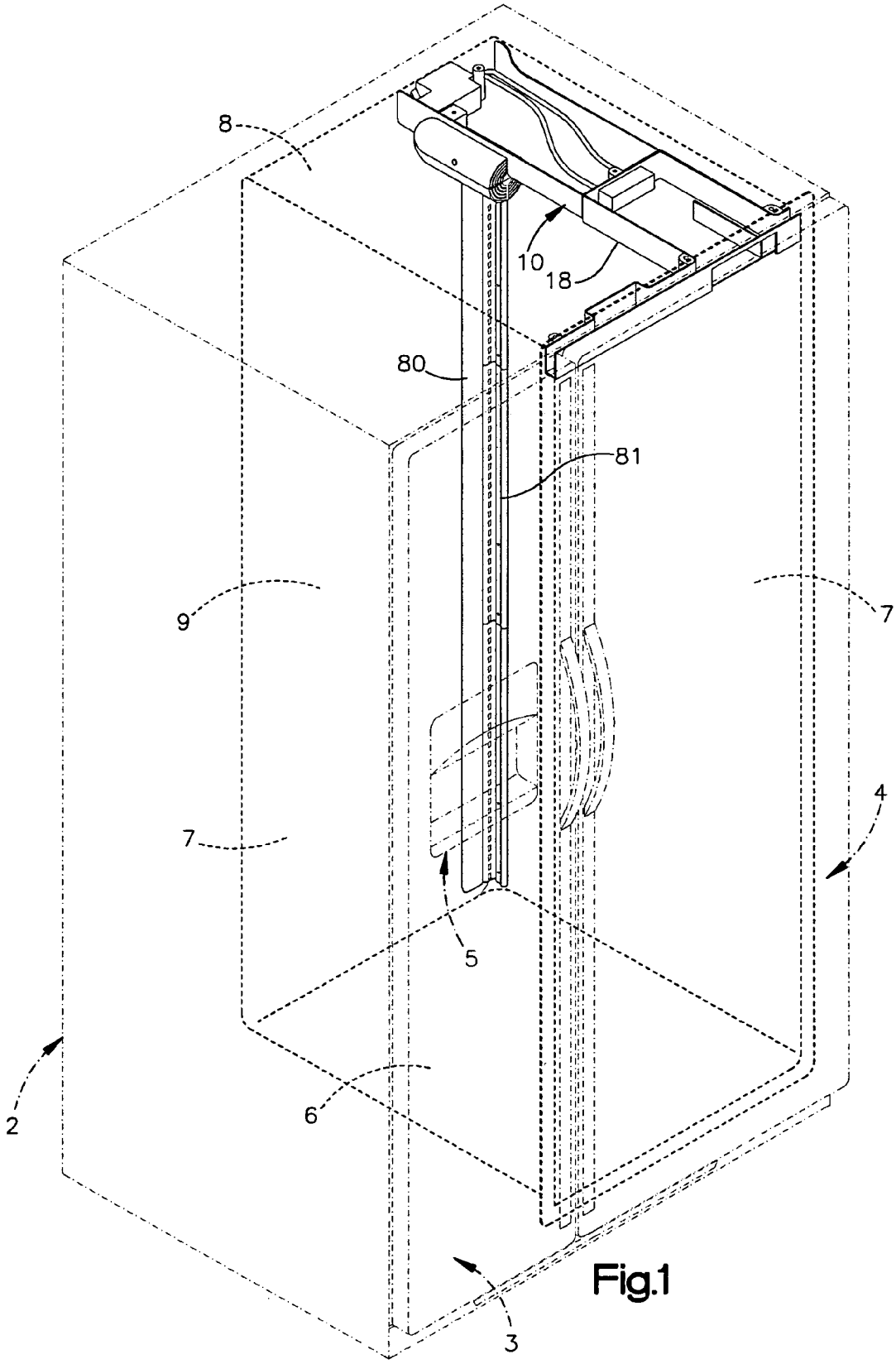
FIG. 1 is a perspective outline in phantom of a type of conventional refrigerator in which the assembly of the invention is illustrated as secured to an interior wall of the refrigerator and certain auxiliary components are shown.

Referring to FIG. 1, the assembly of the invention, indicated generally at 10, is shown mounted within the interior of a refrigerator indicated generally at 2. The refrigerator illustrated in FIG. 1 is a conventional so-called "side-by-side" refrigerator having a freezer compartment on one side, access to which is had through freezer compartment door 3, and a fresh food compartment on the other side, access to which is had through fresh food compartment door 4. It will be understood, however, that the assembly of the invention can be used with any type of refrigerator, including, for example, refrigerators that have the freezer compartment located above or below the fresh food compartment. The freezer compartment door is shown as including a water and/or ice dispensing unit 5 but none of the shelving or storage bins normally included with such a refrigerator is shown so that the description of the invention may be facilitated.

The fresh food compartment has a plurality of interior walls, including bottom wall 6, side walls 7, upper wall 8 and rear wall 9, that define the interior of the fresh food compartment. Although the assembly of the invention 10 is shown in FIG. 1 as mounted to the upper wall 8 of the fresh food co'partment interior, it will be seen from the description that follows that the assembly can be mounted to any of the interior walls of the fresh food compartment of the refrigerator. Further, the assembly of the invention can be mounted to one of the interior walls of the freezer compartment if desired.

Figure 2:
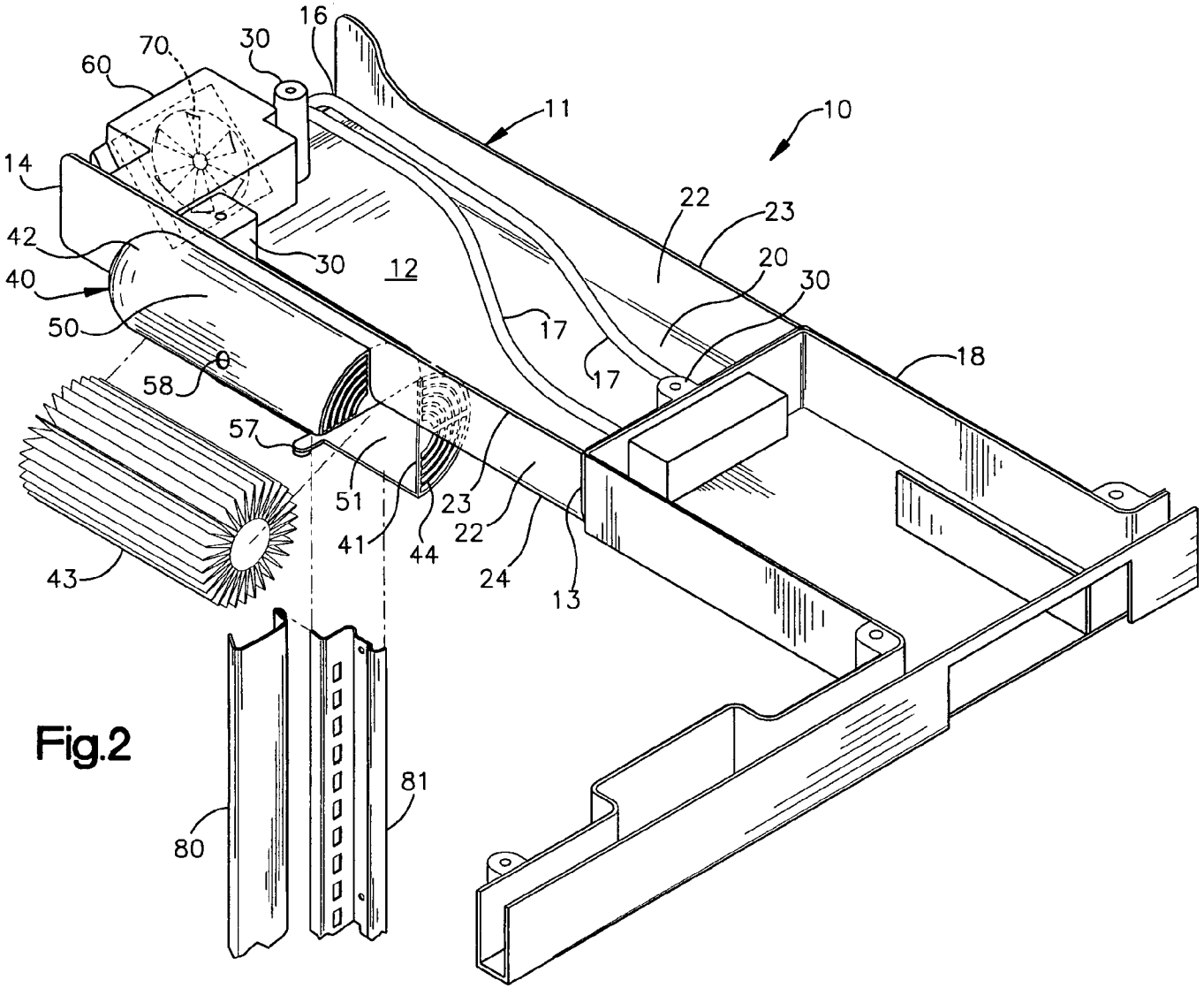
FIG. 2 is a perspective view of the assembly of the invention, shown with the air filter unit having been opened and the air filter removed therefrom, together with certain auxiliary components including a holder for a water filter attached to the assembly and a portion of the channel member used to conduct the water lines to and from the water filter.
Figure 3:
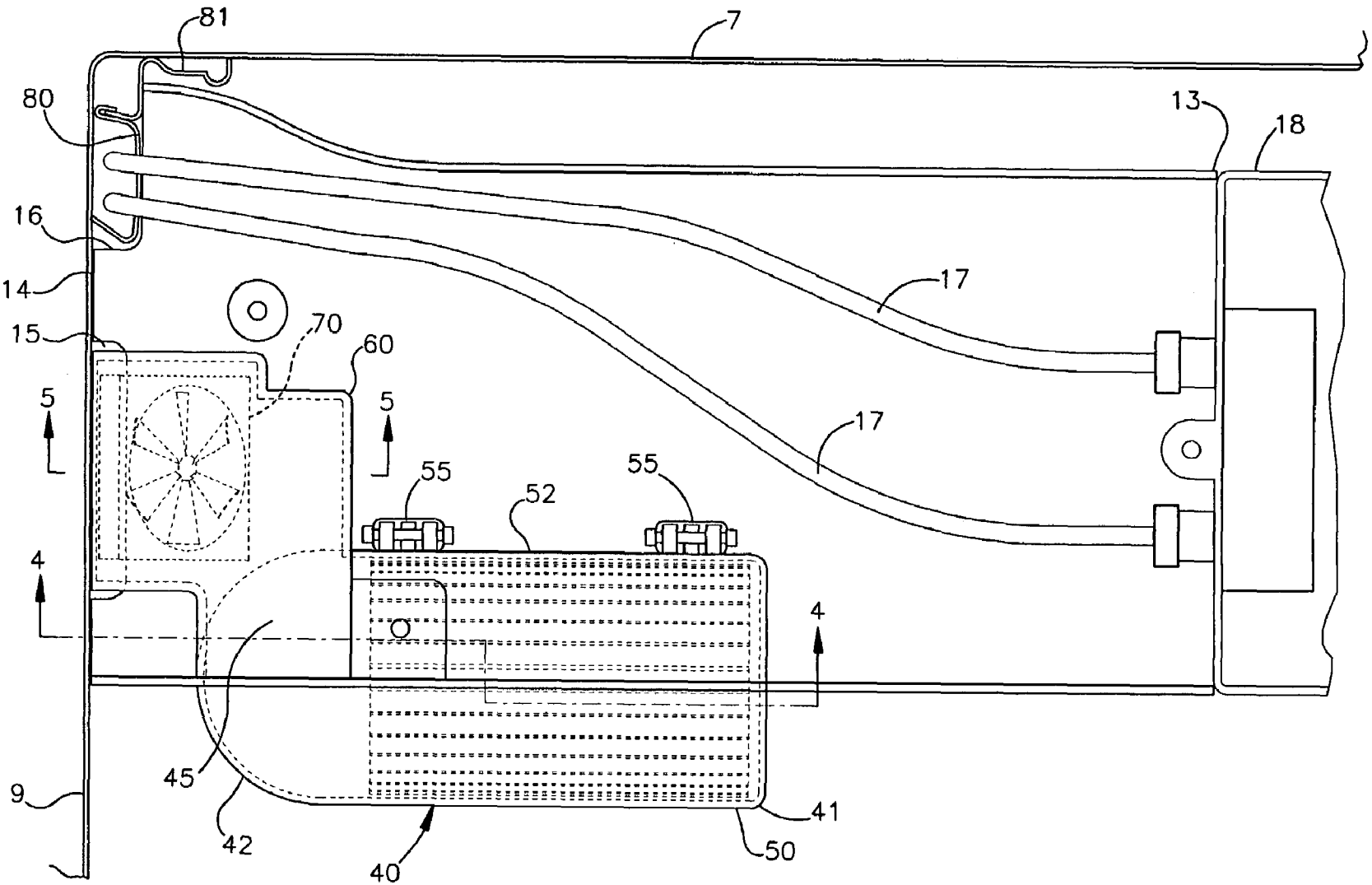
FIG. 3 is a top view of the assembly of the invention, together with certain auxiliary components including a portion of the holder for the water filter, water lines running to and from the holder and the channel member that conducts the water lines to and from the holder.
Figure 4:
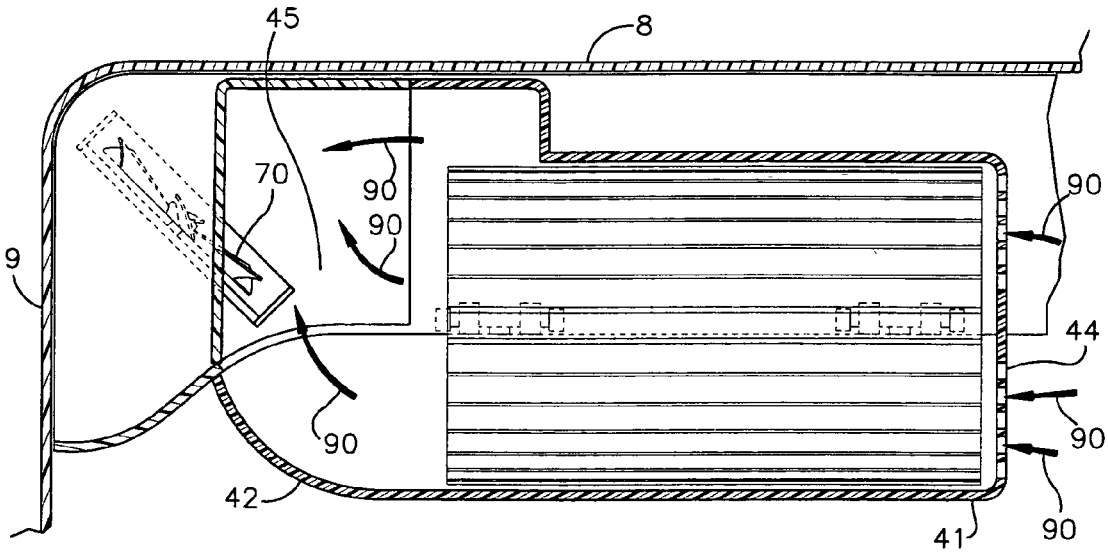
FIG. 4 is a sectional view taken along the line 4-4 of FIG. 3.
Figure 5:
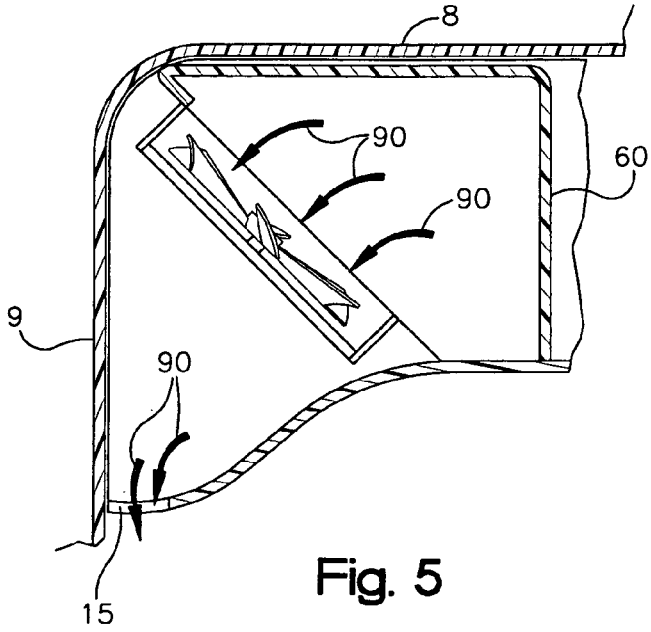
FIG. 5 is a sectional view taken along the line 5-5 of FIG. 3.

The assembly of the invention 10, as best seen in FIGS. 2 and 3 of the drawings, includes an enclosure 11 that has an interior 12 and extends longitudinally between a first end 13 and a second end 14. A service line opening 16 is provided in the enclosure 11, and the interior 12 of the enclosure includes a passageway for conducting at least one refrigerator service line 17 between the service line opening 16 and the first end 13 of the enclosure. In the embodiment of the invention shown in the drawings, the service line opening 16 is located adjacent the second end 14 of the enclosure 11 but, as will be apparent to those skilled in the art, the service line opening can be located at any suitable site in the enclosure 11. The enclosure 11 is adapted to be mounted to one of the interior walls of the refrigerator by means described below.

In the embodiment of the invention shown in the drawings, a holder 18 for retaining a water filter (not shown) is attached to the first end 13 of the enclosure 11. In that instance, one of the service lines 17 comprises a water line for delivering unfiltered water to the water filter in holder 18 and the other service line comprises a water line for passing the water, after it has been filtered, to an ice maker and/or a water dispenser, for example. The passageway in the interior of the enclosure 11 can be used to conduct service lines in addition to or other than water lines between the service line opening 16 and the first end 13 of the enclosure. For example, the first end 13 of the enclosure may be located adjacent to electric controls for operating the refrigerator and the wiring and cables for the electric controls can be conducted through the passageway. Naturally, if the assembly of the invention is located in the freezer compartment of the refrigerator, only service lines that could function effectively in such a cold environment would be used with the enclosure 11. The service lines are conducted from the point where they enter the interior of the fresh food compartment near the bottom of the fresh food compartment to the enclosure 11 by a channel 80. The channel is held in place by an elongate clip 81 that is suitably secured to one of the side walls 7 of the fresh food compartment by suitable fasteners such as screws.

Although the enclosure can have a variety of configurations, the embodiment illustrated in the drawings comprises a three-sided trough having a base wall 20 and two substantially parallel side walls 22 of substantially equal height. Each side wall 22 has a top portion 23 and a bottom portion 24. The bottom portion 24 of each side wall 22 is integral with the base wall 20, and the top portion 23 of each side wall 22 extends in the same direction away from the base wall 20. The trough is adapted to be mounted to the upper interior wall 8 of the refrigerator so that the top portion 23 of each side wall 22 of the trough is immediately adjacent the upper interior wall 8 of the refrigerator and the second end 14 of the trough is immediately adjacent the rear interior wall 9 of the refrigerator. Although any suitable means can be employed to attach the enclosure 11 to the upper interior wall 8 of the refrigerator, in the embodiment of the invention illustrated in the drawings, the enclosure includes several hollow mounting posts 30 that are provided with openings through which the shanks of screws, not shown, are inserted from the bottom side of the enclosure. These screws engage and are fastened to suitable threaded clips, not shown, or the like, that are secured to the upper interior wall 8. Similar means can be included on holder 18 for attaching holder 18 to the upper interior wall 8 of the refrigerator.

The present invention also includes an air filter housing, indicated generally at 40, mounted to the enclosure 11. Although the air filter housing 40 is shown in the embodiment of the invention illustrated in the drawings as part of an assembly together with the enclosure 11, the air filter housing has separate utility and can be used in other settings such as, for example, independently within a refrigerator as will be understood by those skilled in the art.

The air filter housing 40 has a first opening 44 for the ingress of air into the housing and a second opening 45 for the discharge of air from the housing. In the embodiment of the invention illustrated in the drawings, the first opening 44 comprises a grouping of concentric slots adjacent the first end 41 of the air filter housing 40 and the second opening 45 comprises simply an open space located adjacent the second end 42 of the housing. The first and second openings in the air filter housing may take other forms than as described and be located elsewhere in the housing as will be apparent to those skilled in the art based on the description of the invention herein.

An air filter 43 is located in the air filter housing 40 between the first and second openings 44 and 45. The filter 43 can be any of a variety of types. For example, it can be a filter that simply deodorizes the air in the refrigerator or it can be a filter that in addition to deodorizing the refrigerator otherwise sanitizes the refrigerator by removing bacteria and/or mold spores.

Although it can assume various configurations, the air filter housing 40 in the embodiment of the invention shown in the drawings, as best seen in FIG's. 2 and 3, has a generally cylindrical configuration with a longitudinal central axis that extends substantially parallel to the longitudinal extent of the enclosure 11. As a result, the first end 41 of the filter housing 40 is nearer the first end 13 of the enclosure 11 and the second end 42 of the filter housing is nearer the second end 14 of the enclosure 11.

In the embodiment of the invention illustrated in the drawings, the air filter housing 40 includes a first portion, comprising a first longitudinal half 50, and a second portion, comprising a second longitudinal half 51, that are separated along a longitudinal plane that extends through the longitudinal central axis of the air filter housing. The first longitudinal half 50 is fixed to the enclosure 11 and, as best seen in FIG. 3, has a part 52 thereof located within the interior 12 of the enclosure 11. The remainder of the first longitudinal half is located on the exterior of the enclosure 11. The part 52 of the first longitudinal half 50 of the air filter housing extends into the interior 12 of the enclosure 11 along side the passageway for conducting the refrigerator service lines 17. The second longitudinal half 51 of the air filter housing comprises a part of the air filter housing that is located at the exterior of the enclosure 11 and is displaceable from the remainder of the air filter housing so as to provide access to the air filter 43 within the air filter housing. Specifically, in the embodiment illustrated in the drawings, the second longitudinal half 51 is located substantially entirely on the exterior of the enclosure 11 and is mounted by means of hinges 55 so that the first longitudinal half 50 and the second longitudinal half 51 are pivotally connected to one another and, thus, are pivotally separable from one another. Stated otherwise, the second longitudinal half 51 is mounted for pivotal movement away, and displacement from, the first longitudinal half 50 of the air filter housing. In the embodiment of the invention illustrated in the drawings, the air filter 43 is replaceable, as is the water filter held in holder 18 and, for the ease of replacing these two elements, the air filter housing 40 and the holder 18 are located generally adjacent one another. However it is not necessary that they be so located.

In the embodiment of the invention illustrated in the drawings, the air filter 43 is supported by the second longitudinal half 51 of the housing 40 so that, as best illustrated in FIG. 2, the air filter accompanies the second longitudinal half 51 when the latter is pivotally. separated from the first longitudinal half 50. Thus, in the embodiment of the invention shown in the drawings, the air filter unit is adapted to be mounted within the interior of the refrigerator so that the second portion, or second longitudinal half 51, of the air filter housing is pivotally movable in a downward direction away from the first portion, or first longitudinal half 50, of the air filter housing. It will be understood that in circumstances such as, for example, where the housing 40 is not attached to the enclosure but is used separately, either the first portion 50 or the second portion 51 of the filter housing can support the air filter 43. Access to the filter 43 within the air filter housing 40 is thereby provided so that the filter may be replaced when desired. The first and second longitudinal halves of the air filter housing are maintained in a closed position by any suitable fastening arrangement. In the embodiment of the invention shown in the drawings, the longitudinal half 51 includes a catch 57 that has a protuberance that engages the opening 58 in the longitudinal half 52 for the purpose of keeping the air filter housing closed.

The assembly of the invention also includes an air flow path that is adapted to convey to the refrigerator interior air discharged from the second opening 45 in the air filter housing 11. In the embodiment of the invention illustrated in the drawings, the air flow path is defined by the duct 60 that is located within the enclosure interior 12 and extends from the second opening 45 in the air filter housing to an exhaust opening 15 in the base wall 20 adjacent the second end 14 of the enclosure 11. The duct 60 is in fluid communication at one of its ends with the opening 45 and at its other end with the exhaust opening 15 which comprises a portion of the air flow path. It will be understood that the air flow path can be defined other than by the duct 60. For example, the opening 45 may, simply, be open directly to the interior of the refrigerator, particularly in the case where the air filter unit is used separately from the enclosure 11, or the opening 45 may be in fluid communication with a duct that is located at the exterior of the enclosure 11 and exhausts to the refrigerator interior air that has passed through the filter.

Although the usual air flow patterns that typically exist in a refrigerator can be relied on to cause air to flow through the filter 43 and subsequently to the interior of the refrigerator, the embodiment of the invention illustrated in the drawings includes means for establishiing a flow of air into the air filter housing 40 through the first opening 44 in the air filter housing, through the filter 43, out of the air filter housing through the second opening 45 in the air filter housing, along the air flow path and into the refrigerator interior. Specifically, an electrically-powered fan 70 is mounted in the air flow path in duct 60 so as to direct air through the filter 43 as described. The fan is inclined at an angle so as to direct the air downwardly through the exhaust opening 15 in a manner to provide a downward momentum to the filtered air discharged through the exhaust opening. Thus, with the enclosure 11 being adapted to be positioned in the fresh food compartment of the refrigerator so that the exhaust opening 15 is located adjacent the rear interior wall 8 of the fresh food compartment, the air that flows through the exhaust opening is directed downwardly along the rear interior wall. The flow of filtered air into the filter housing 40, out the opening 45 of the housing, through the duct 60 and out the exhaust opening 15 is indicated by the arrows 90.

The above description is intended to enable a person skilled in the art to practice the invention. It is not intended to detail all the possible modifications and variations that will be apparent to those skilled in the art upon reading the description with reference to the drawings. It is intended, however, that all modifications and variations be included within the scope of the invention as defined in the claims below.

What is claimed is:

1. An assembly for installation in a refrigerator having a plurality of interior walls defining a refrigerator interior, the assembly comprising:

an enclosure having an interior, an exterior, and extending longitudinally between a first end and a second end, a service line opening in the enclosure, the interior of the enclosure including a passageway for conducting at least one refrigerator service line between the service line opening and the interior of the enclosure, the enclosure mounted to one of the plurality of interior walls of the refrigerator by means for attaching;

an air filter housing mounted to the enclosure, the air filter housing being attached to the exterior of the enclosure with a portion of the air filter housing extending into the interior of the enclosure, and at least another portion of the air filter housing being located exterior of the enclosure and displaceable from the remainder of the air filter housing so as to provide access into the air filter housing;

the air filter housing having a first opening for the ingress of air into the air filter housing and a second opening for the discharge of air from the air filter housing;

an air filter located in the air filter housing for filtering air entering the air filter housing; and an air flow path conveying to the refrigerator interior air discharged from the second opening in the air filter housing.

2. The assembly of claim 1 wherein the service line opening is located adjacent the second end of the enclosure and the first end of the enclosure is attached to a holder for retaining a water filter.

3. The assembly of claim 2 wherein the air filter and the water filter are replaceable and the air filter housing and the holder for retaining the water filter are located generally adjacent one another.

4. The assembly of claim 1 including means for establishing a flow of air into the air filter housing through the first opening in the air filter housing, through the filter, out of the air filter housing through the second opening in the air filter housing, along the air flow path and into the refrigerator interior.

5. The assembly of claim 4 wherein the air flow path is located within the enclosure interior and includes an exhaust opening at the second end of the enclosure.

6. The assembly of claim 5 wherein the service line opening is located adjacent the second end of the enclosure and the first end of the enclosure is attached to a holder for retaining a water filter.

7. The assembly of claim 4 wherein the means for establishing a flow of air into the air filter housing comprises a fan that is located in the air flow path.

8. The assembly of claim 7 wherein the enclosure is adapted to be positioned in the fresh food compartment of the refrigerator interior so that the exhaust opening is located adjacent a rear interior wall of the fresh food compartment and the air flow through the exhaust opening is directed downwardly along the rear interior wall.

9. The assembly of claim 1 wherein at least a portion of the air filter housing extends into the interior of the enclosure along side the passageway for conducting the at least one refrigerator service line.

10. The assembly of claim 9 wherein the air filter housing has a generally cylindrical configuration with a longitudinal central axis extending substantially parallel to the longitudinal extent of the enclosure so that the air filter housing has a first end nearer the first end of the enclosure for the ingress of air and a second end nearer the second end of the enclosure for the egress of air, the first opening in the air filter housing being located adjacent the first end of the air filter housing and the second opening in the air filter housing being located adjacent the second end of the air filter housing.

11. The assembly of claim 10 wherein the air filter housing comprises a first longitudinal half and a second longitudinal half that are separated along a longitudinal plane that extends through the longitudinal central axis of the air filter housing, the first of the longitudinal halves of the air filter housing being fixed to the enclosure and having a portion thereof located within the interior of the enclosure, and the second of the longitudinal halves being located substantially entirely on the exterior of the enclosure and being mounted for pivotal movement away, and displacement, from the first longitudinal half of the air filter housing so as to provide access to the air filter within the air filter housing.

12. The assembly of claim 11 wherein the means for establishing a flow of air into the air filter housing comprises a fan that is located in the air flow path.

13. The assembly of claim 12 wherein the enclosure is adapted to be positioned in the fresh food compartment of the refrigerator interior so that the exhaust opening is located adjacent a rear interior wall of the fresh food compartment and the air flow through the exhaust opening is directed downwardly along the rear interior wall.

14. The assembly of claim 4 wherein the air filter housing has a generally cylindrical configuration with a longitudinal central axis extending substantially parallel to the longitudinal extent of the enclosure so that the air filter housing has a first end nearer the first end of the enclosure and a second end nearer the second end of the enclosure, the first opening in the air filter housing being located adjacent the first end of the air filter housing and the second opening in the air filter housing being located adjacent the second end of the air filter housing.

15. The assembly of claim 14 wherein the air filter housing comprises two longitudinal halves that are separated along a longitudinal plane that extends through the longitudinal central axis of the air filter housing, the first of the longitudinal halves of the air filter housing being fixed to the enclosure and having a portion thereof located within the interior of the enclosure, and the second of the longitudinal halves being located substantially entirely on the exterior of the enclosure and being mounted for pivotal movement away, and displacement, from the first longitudinal half of the air filter housing so as to provide access to the air filter within the air filter housing.

16. The assembly of claim 15 wherein the air flow path is located within the enclosure interior and includes an exhaust opening at the end of the second enclosure.

17. The assembly of claim 15 wherein the means for establishing a flow of air into the air filter housing comprises a fan that is located in the air flow path.

18. The assembly of claim 4 wherein the enclosure comprises a three-sided trough having a base wall and two substantially parallel side walls of substantially equal height, each side wall having a top portion and a bottom portion, with the bottom portion of each side wall being integral with the base wall and the top portion of each side wall extending in the same direction away from the base wall, the trough being adapted to be mounted to an upper interior wall of the refrigerator so that the top portion of each side wall of the trough is immediately adjacent the upper interior wall and the second end of the trough is immediately adjacent a rear interior wall of the refrigerator.

19. The assembly of claim 18 including an exhaust opening in the base wall adjacent the second end of the trough, the exhaust opening comprising a portion of the air flow path between the second opening in the air filter housing and the refrigerator interior, and wherein the air flow path is located within the trough interior.

20. The assembly of claim 19 wherein the means for establishing a flow of air into the air filter housing comprises a fan that is located in the air flow path.

21. The assembly of claim 20 wherein at least a portion of the air filter housing is located at the exterior of the trough and is displaceable from the remainder of the air filter housing so as to provide access to the air filter within the air filter housing.

22. The assembly of claim 21 wherein at least a portion of the air filter housing extends into the interior of the enclosure along side the passageway for conducting at least one refrigerator service line.

23. The assembly of claim 22 wherein the air filter housing has a generally cylindrical configuration with a longitudinal central axis extending substantially parallel to the longitudinal extent of the trough so that the air filter housing has a first end nearer the first end of the trough and a second end nearer the second end of the trough, the first opening in the air filter housing being located adjacent the first end of the air filter housing and the second opening in the air filter housing being located adjacent the second end of the air filter housing.

24. The assembly of claim 23 wherein the air filter housing comprises a first longitudinal half and a second longitudinal half that are separated along a longitudinal plane that extends through the longitudinal central axis of the air filter housing, the first of the longitudinal halves of the air filter housing being fixed to the trough and having a portion thereof located within the trough interior, and the second of the longitudinal halves being located substantially entirely on the exterior of the trough and being mounted for pivotal movement away, and displacement, from the first longitudinal half of the air filter housing so as to provide access to the air filter within the air filter housing.

25. The assembly of claim 24 wherein the trough includes means for attaching the trough to the upper interior wall of the refrigerator.

26. An air filter unit for a refrigerator, the air filter unit comprising:

an air filter housing having a first portion and a second portion, the first portion and the second portion of the air filter housing being pivotally connected to one another so that the first portion and the second portion of the air filter housing are pivotally separable from one another, the air filter housing having a first opening for the ingress of air into the air filter housing and a second opening for the discharge of air from the air filter housing; and an air filter located in the air filter housing for filtering air entering the air filter housing, the air filter being supported by one of the first portion and second portion of the air filter housing so that the air filter accompanies the one of the first portion and second portion of the air filter housing by which the air filter is supported when the first portion and the second portion of the air filter housing are pivotally separated from one another;

the air filter being mounted to an enclosure on the top side of the refrigerator, the first portion of the air filter unit being adapted to be retained in a fixed position, the second portion of the air filter unit being pivotally movable away from the first portion of the air filter housing, the air filter being supported by the second portion of the air filter.

27. The air filter unit of claim 26 wherein the air filter housing has a generally cylindrical configuration with a longitudinally extending central axis, the first portion of the housing comprises a first longitudinal half of the housing and the second portion of the housing comprises a second longitudinal half of the housing, the first longitudinal half and the second longitudinal half being separated along a longitudinal plane that extends through the longitudinal central axis of the air filter housing.

28. The air filter unit of claim 26 including means for establishing a flow of air into the air filter housing through the first opening in the air filter housing, through the filter and out of the air filter housing through the second opening in the air filter housing.

29. The air filter unit of claim 28 wherein the means for establishing a flow of air into the air filter housing comprises a fan.

30. The air filter unit of claim 26 wherein the air filter unit is adapted to be mounted within the interior of a refrigerator so that the second portion of the air filter housing is pivotally movable in a downward direction away from the first portion of the air filter housing.

31. The air filter unit of claim 30 including means for establishing a flow of air into the air filter housing through the first opening in the air filter housing, through the filter and out of the air filter housing through the second opening in the air filter housing.

32. The air filter unit of claim 31 wherein the means for establishing a flow of air into the air filter housing comprises a fan.

33. The air filter unit of claim 26 wherein the air filter housing has a generally cylindrical configuration with a longitudinally extending central axis, the first portion of the housing comprises a first longitudinal half of the housing and the second portion of the housing comprises a second longitudinal half of the housing, the first longitudinal half and the second longitudinal half being separated along a longitudinal plane that extends through the longitudinal central axis of the air filter housing.

34. The air filter unit of claim 33 wherein the air filter unit is adapted to be mounted within the interior of a the refrigerator so that the second portion of the air filter housing is pivotally movable in a downward direction away from the first portion of the air filter housing.

35. The air filter unit of claim 34 including means for establishing a flow of air into the air filter housing through the first opening in the air filter housing, through the filter and out of the air filter housing through the second opening in the air filter housing.

36. The air filter unit of claim 35 wherein the means for establishing a flow of air into the air filter housing comprises a fan.

37. The air filter unit of claim 26 including an air flow path adapted to convey to the refrigerator interior air discharged from the second opening in the air filter housing.

38. The air filter unit of claim 37 wherein the air flow path is adapted to convey the air discharged from the second opening in the air filter housing along the rear wall of the refrigerator.

39. The air filter unit of claim 27 including means for establishing a flow of air into the air filter housing through the first opening in the air filter housing, through the filter and out of the air filter housing through the second opening in the air filter housing.

40. The air filter unit of claim 39 wherein the means for establishing a flow of air into the air filter housing comprises a fan.

41. The air filter unit of claim 27 including an air flow path adapted to convey to the refrigerator interior air discharged from the second opening in the air filter housing.

42. The air filter unit of claim 41 wherein the air flow path is adapted to convey the air discharged from the second opening in the air filter housing along the rear wall of the refrigerator.

43. The air filter unit of claim 35 including an air flow path adapted to convey to the refrigerator interior air discharged from the second opening in the air filter housing.

44. The air filter unit of claim 43 wherein the air flow path is adapted to convey the air discharged from the second opening in the air filter housing along the rear wall of the refrigerator.

45. The air filter unit of claim 43 wherein the means for establishing a flow of air into the air filter housing comprises a fan.

46. The air filter unit of claim 29 wherein the means for establishing a flow of air into the air filter housing comprises a fan.

47. A refrigerator, comprising:

a cabinet defining a refrigerated compartment;

an insulated refrigerator door moveably mounted to the cabinet for selectively closing the refrigerated compartment;

a refrigeration system for cooling the refrigerated compartment;

an air filter housing attached to a portion of the cabinet and having a first portion and a second portion, the first portion and the second portion of the air filter housing being connected to one another so that the first portion and the second portion of the air filter housing are separable from one another, the air filter housing having a first opening for the ingress of air into the air filter housing and a second opening for the discharge of air from the air filter housing; and an air filter located in the air filter housing for filtering air entering the air filter housing, the air filter being supported by one of the first portion and second portion of the air filter housing so that the air filter accompanies the one of the first portion and second portion of the air filter housing by which the air filter is supported when the first portion and the second portion of the air filter housing are separated from one another.

* * * * *